US007426755B2

(12) United States Patent
Grilliot et al.

(10) Patent No.: US 7,426,755 B2
(45) Date of Patent: Sep. 23, 2008

(54) PROTECTIVE GARMENT HAVING OUTER SHELL, INTERMEDIATE AND INNER LINERS, AND LINER-INDICATING MEANS

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 875 days.

(21) Appl. No.: 10/869,769

(22) Filed: Jun. 16, 2004

(65) Prior Publication Data

US 2005/0278822 A1 Dec. 22, 2005

(51) Int. Cl.
*A41D 13/00* (2006.01)

(52) U.S. Cl. ..... 2/81; 2/93

(58) Field of Classification Search ..... 2/69, 2/79, 81, 85, 86, 93, 97, 272
See application file for complete search history.

(56) References Cited

U.S. PATENT DOCUMENTS

| | | | | |
|---|---|---|---|---|
| 867,433 | A | | 10/1907 | Smith |
| 2,019,993 | A | | 11/1935 | Regal |
| 2,437,223 | A | | 3/1948 | Dutrow |
| 2,527,258 | A | | 10/1950 | Kahn |
| 2,647,261 | A | | 8/1953 | Rassner |
| 4,386,438 | A | | 6/1983 | Evin |
| 4,507,806 | A | | 4/1985 | Coombs |
| 4,768,233 | A | | 9/1988 | Grilliot et al. |
| 4,774,725 | A | * | 10/1988 | Page ..... 2/81 |
| 4,817,210 | A | | 4/1989 | Aldridge et al. |
| 5,038,410 | A | | 8/1991 | Grilliot et al. |
| 5,054,125 | A | | 10/1991 | Snedeker |
| 5,090,058 | A | | 2/1992 | Gerber |
| 5,189,737 | A | | 3/1993 | Ribicic |
| 5,884,332 | A | * | 3/1999 | Snedeker ..... 2/97 |
| 6,038,700 | A | * | 3/2000 | Aldridge et al. ..... 2/81 |
| 6,339,843 | B1 | | 1/2002 | Grilliot et al. |

OTHER PUBLICATIONS

U.S. Appl. No. 10/869,277, filed Jun. 14, 2004, Grilliot et al.

* cited by examiner

*Primary Examiner*—Danny Worrell
(74) *Attorney, Agent, or Firm*—Wood, Phillips, Katz, Clark & Mortimer

(57) ABSTRACT

In a protective garment comprising an outer shell, an intermediate liner, and an inner liner, a visual indication whether each liner is being worn, is provided to a person observing the outer shell, while the protective garment is being worn, via a tab extending from such liner and being manipulatable to an indicating position, in which the tab extending from such liner can be detachably attached to another part of the protective garment. In its indicating position, the tab extending from the intermediate liner can be detachably attached to the outer shell. In its indicating position, the tab extending from the inner liner can be detachably attached to the outer shell, in one contemplated embodiment, or to the tab extending from the intermediate liner, in an alternative embodiment.

10 Claims, 2 Drawing Sheets

PROTECTIVE GARMENT HAVING OUTER SHELL, INTERMEDIATE AND INNER LINERS, AND LINER-INDICATING MEANS

TECHNICAL FIELD OF THE INVENTION

This invention pertains to a protective garment, such as a protective coat, protective pants, protective coveralls, or protective overalls, which is worn by a firefighter or by an emergency rescue worker.

BACKGROUND OF THE INVENTION

As exemplified in U.S. Pat. No. 5,038,410, the disclosure of which is incorporated by reference herein, it is known to provide a protective garment, which has an outer shell and a thermal liner, with a tab extending from the thermal liner. The tab is attachable detachably to the outer shell, as an indicator that the thermal liner is being worn within the outer shell.

Other protective garments having liner-detecting or liner-indication features are disclosed in U.S. Pat. No. 4,507,806, No. 4,774,725, No. 4,768,233, and No. 4,817,210 (which are discussed in columns 1 and 2 of U.S. Pat. No. 5,038,410) and in U.S. Pat. No. 4,386,438.

As exemplified in U.S. Pat. No. 6,339,843 B1, the disclosure of which is incorporated by reference herein, it is known for a protective garment having an outer shell, a liner including a moisture barrier, and a thermal liner to be selectively configured with neither liner attached within the outer shell, with either liner attached within the outer shell, or with both liners attached within the outer shell.

At a firefighting or other emergency incident, it is important for responsible personnel, such as incident commanders and safety officers, quickly to ascertain whether the protective garments worn by personnel responding to the incident are appropriate for the incident.

Commonly, such personnel refer to National Fire Protection Association (NFPA) standards, which currently include NFPA 1999 (03) for "Protective Clothing for Emergency Medical Operations", which commonly and hereinafter is abbreviated as NFPA 1999, NFPA 1992 (00) for "Liquid Splash-Protective Clothing for Hazardous Materials Emergencies", which commonly and hereinafter is abbreviated as NFPA 1992, NFPA 1977 (98) for "Protective Clothing and Equipment for Wildland Fire Fighting", which commonly and hereinafter is abbreviated as NFPA 1977, NFPA 1971 (00) "Protective Ensemble for Structural Firefighting", which commonly and hereinafter is abbreviated as NFPA 1971, and NFPA 1951 (01) for "Protective Ensemble for USAR Operations", which commonly and hereinafter is abbreviated as NFPA 1951. USAR is an acronym for Urban Search and Rescue.

Broadly, for a protective garment to conform to NFPA (1977), the protective garment must have an outer shell but does not have to have a liner providing a moisture barrier or a thermal liner. Broadly, for a protective garment to conform to NFPA 1999, to NFPA 1992, or to NFPA 1951, the protective garment must have a liner providing a moisture barrier, as well as an outer shell, but does not have to have a thermal liner. Broadly, for a protective garment to conform to NFPA 1971, the protective garment must have an outer shell, a liner providing a moisture barrier, and a thermal liner.

SUMMARY OF THE INVENTION

Broadly, this invention provides a protective garment comprising an outer shell, an intermediate liner wearable within the outer shell, and an inner liner wearable within the intermediate liner, and further comprising means for indicating visually to a person observing the outer shell, while the protective garment is being worn, whether the intermediate liner is being worn within the outer shell and whether the inner liner is being worn within the intermediate liner.

Embodiments are contemplated wherein the indicating means comprises a tab extending from the intermediate liner and being visible to a person observing the outer shell, while the protective garment is being worn, if the intermediate liner is being worn within the outer shell, and wherein the indicating means comprises a tab extending from the inner liner and being visible to a person observing the outer shell, while the protective garment is being worn, if the inner liner is being worn within the intermediate liner.

Embodiments are contemplated wherein the tab extending from each liner is manipulatable to an indicating position, in which the tab extending from said liner can be detachably attached to another part of the protective garment and in which the tab extending from said liner indicates to a person observing the outer shell, while the protective garment is being worn, that said liner is being worn. In one such embodiment, the tab extending from each liner, when manipulated to its indicating position, can be detachably attached to the outer shell. Preferably, in the same embodiment, the tabs are spaced from each other when and where so attached to the outer shell. In another such embodiment, the tab extending from the intermediate liner is manipulatable to an indicating position, in which the tab extending from the intermediate liner can be detachably attached to the outer shell, and the tab extending from the inner is manipulatable to an indicating position, in which the tab extending from the liner can be detachably attached to the tab extending from the intermediate liner.

Embodiments are contemplated wherein the tab extending from the intermediate liner, when manipulated to its indicating position, displays an indicium or indicia that the protective garment conforms to at least one standard for protective garments and wherein the tab extending from the inner liner, when manipulated to the indicating position, displays an indicium or indicia that the protective garment conforms to at least one standard for protective garments and, optionally, the outer shell displays an indicium or indicia that the protective garment conforms to at least one standard for protective garments. The indicated standards are different standards.

DETAILED DESCRIPTION OF THE ILLUSTRATED EMBODIMENTS

Figure 1:
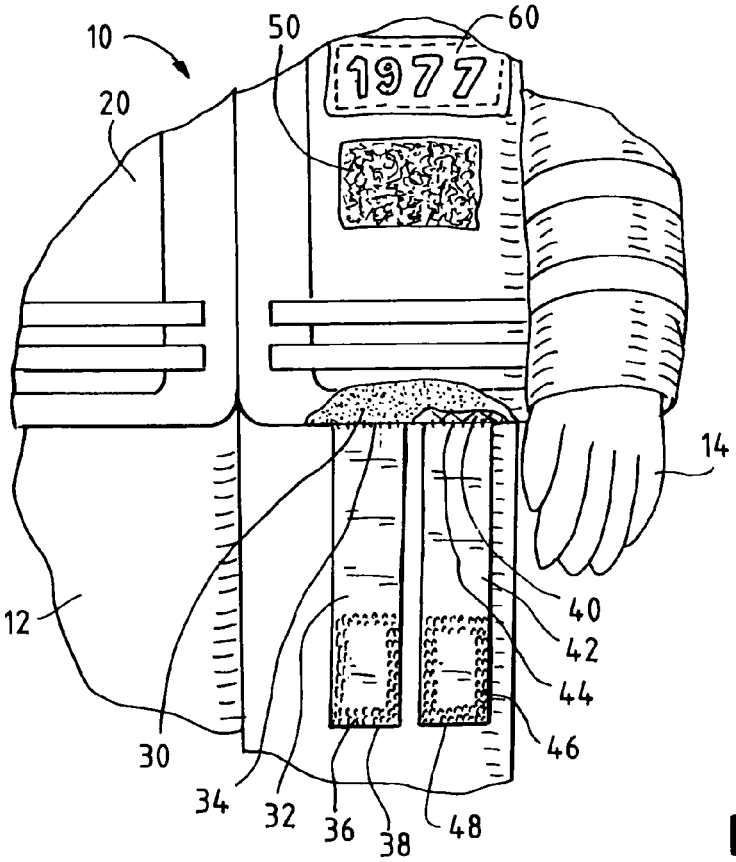
FIG. 1 is a fragmentary, front view of a protective ensemble comprising a protective coat, which constitutes a first embodiment of this invention.
Figure 2:
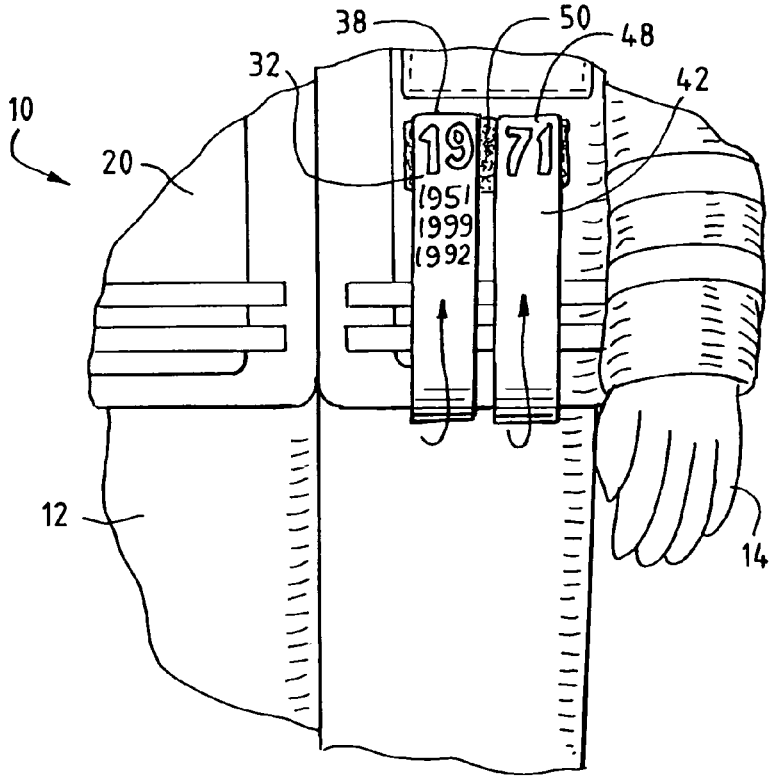
FIG. 2 is a similar view illustrating two indicating tabs, each in an indicating position.

As illustrated in FIGS. 1 and 2, a protective ensemble for a firefighter comprises a protective coat 10, a pair of protective pants 12, and a pair of protective gloves 14, one such glove being illustrated, and. The protective coat 10, which constitutes a first embodiment of this invention, comprises an outer shell 20, an intermediate liner 30 providing a moisture barrier, and an inner, thermal liner 40. The intermediate liner 30, which is illustrated fragmentarily in FIG. 1, is wearable within the outer shell 20. The inner liner 40, which is illustrated fragmentarily in FIG. 1, is wearable within the intermediate liner 30.

As disclosed in U.S. Pat. No. 6,339,843 B1, supra, the protective coat 10 is wearable with neither liner 30, 40, being worn within the outer shell 20, or with the intermediate liner 30 being worn within the outer shell 20 but without the inner liner 40 being worn within the intermediate liner 30, or with the inner liner 40 being worn within the outer shell 20 but without the intermediate liner 30 being worn within the outer shell 20, or with the intermediate liner 30 being worn within the outer shell 20 and with the inner liner 40 being worn within the intermediate liner 30. This invention provides the protective coat 10 with means for indicating visually to a person observing the outer shell 20, while the protective coat 10 is being worn, whether the intermediate liner 30 is being worn and whether the inner liner 30 is being worn.

As illustrated in FIGS. 1 and 2, the indicating means comprises a flexible, fabric tab 32 sewn to and extending from a lower edge 34 of the intermediate liner 30. The tab 32 is visible to a person observing the outer shell 20, while the protective coat 10 is being worn, if the intermediate liner 30 is being worn within the outer shell 20. Moreover, the indicating means comprises a flexible, fabric tab 42 sewn to and extending from a lower edge 44 of the inner liner 40. The tab 42 is visible to a person observing the outer shell 20, while the protective coat 10 is being worn, if the inner liner 40 is being worn.

The tab 32 extending from the intermediate liner 30 is manipulatable to an indicating position, in which the tab 32 extending from the intermediate liner 30 can be detachably attached to the outer shell 20 and in which the tab 32 extending from the intermediate liner 30 indicates to a person observing the outer shell 20, while the protective coat 10 is being worn, that the intermediate liner 30 is being worn. The tab 42 extending from the inner liner 40 is manipulatable to an indicating position, in which the tab 42 extending from the inner liner 40 can be detachably attached to the outer shell 20 and in which the tab 42 extending from the inner liner 44 indicates to a person observing the outer shell 20, while the protective coat 10 is being worn, that the inner liner 40 is being worn. The respective tabs 32, 42, are spaced from each other when and where so attached to the outer shell 20.

As illustrated in FIG. 1, a fabric patch 60 is sewn to the outer shell 20, above the hook-faced panel 50. The fabric patch 60 is embroidered with an indicium "1977", whereby the outer shell 20 displays the indicium "1977", which is an abbreviated indication that the protective coat 10 with the outer shell 20 and with or without either liner 30, 40, conforms to NFPA 1977.

As illustrated in FIG. 2, when the tab 32 extending from the intermediate liner 30 is manipulated to its indicating position, the tab 32 displays a partial indicium "19" to be later described. Moreover, the tab 32 displays the indicia "1951", with which the tab 32 is embroidered and which is an abbreviated indication that the protective coat 20 with the outer shell 20, with the intermediate liner 30, and with or without the inner liner 40, conforms to NFPA 1951 (01) for "Protective Ensemble for USAR Operations". Moreover, the tab 32 displays the indicium "1992", with which the tab 32 is embroidered and which is an abbreviated indication that the protective coat 20 with the outer shell 20, with the intermediate liner 30, and with or without the inner liner 40, conforms to NFPA 1992. Furthermore, the tab 32 displays the indicium "1999", with which the tab 32 is embroidered and which is an abbreviated indication that the protective coat 20 with the outer shell 20, with the intermediate liner 30, and with or without the inner liner 40, conforms to NFPA 1999.

As illustrated in FIG. 2, when the tab 42 extending from the inner liner 40 is manipulated to its indicating position, the tab 42 displays a partial indicium "71", with which the tab 42 is embroidered and which disposed so as to be readable with the partial indicium "19" if the tab 32 is manipulated to its indicating position, as an indicium "1971", which is an abbreviated indication that the protective coat 20 with the outer shell 20, with the intermediate liner 30, and with the inner liner 40, conforms to NFPA 1971.

As means for enabling the tab 32 extending from the intermediate liner 30 to be detachably attached to the outer shell 20, the protective coat 10 comprises hook-and-loop fastening means (e.g. Velcro™ fastening means) comprising a loop-faced panel 36 sewn to an end portion 38 of the tab 32 and coactive with a hook-faced panel 50 sewn to the outer shell 20. As means for enabling the tab 42 extending from the inner liner 40 to be detachably attached to the outer shell 20, the protective coat 10 comprises similar fastening means comprising a loop-faced panel 46 sewn to an end portion 48 of the tab 42 and coactive with the hook-faced panel 50. The end portions 38, 48, of the respective tabs 32, 42, are spaced from each other when and where attached detachably to the outer shell 20.

Figure 3:
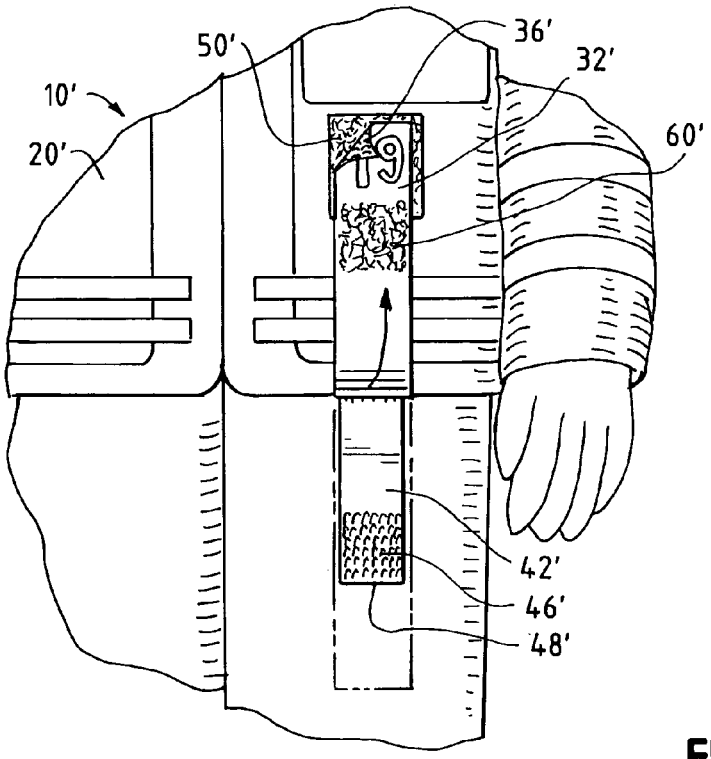
FIG. 3 is a fragmentary, front view of a protective ensemble comprising a protective coat, which constitutes a second embodiment of this invention.
Figure 4:
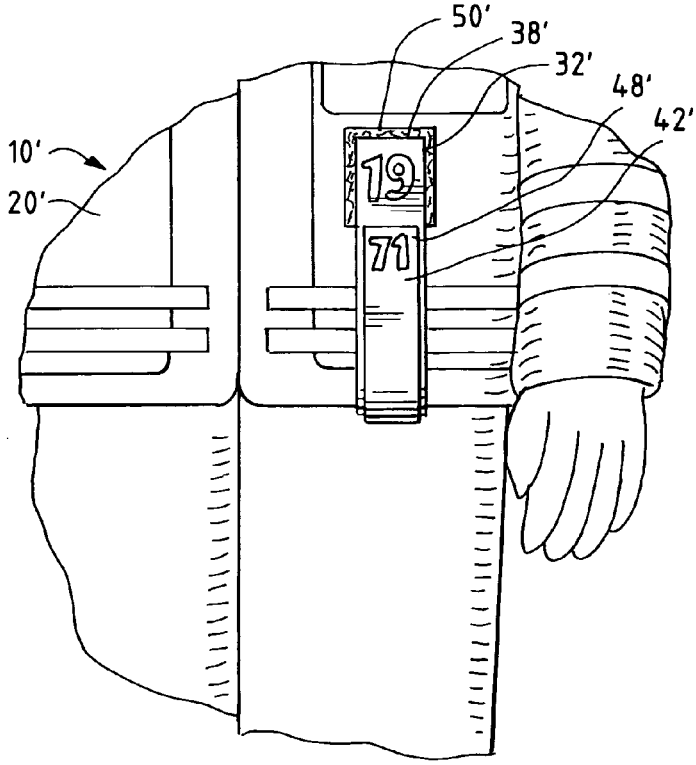
FIG. 4 is a similar view illustrating two indicating tabs, each in an indicating position.

As illustrated in FIGS. 3 and 4, a protective ensemble for a firefighter comprises protective pants, protective gloves, one such glove being illustrated, and a protective coat 10', which constitutes a second embodiment of this invention. The protective coat 10" is similar to the protective coat 10 and comprises an outer shell 20' similar to the outer shell 20, an intermediate liner (not illustrated) similar to the intermediate liner 30, and an inner liner (not illustrated) similar to the inner liner 40.

The protective coat 10' comprises a flexible, fabric tab 32' extending from the intermediate liner and a flexible, fabric tab 42' extending from the inner liner. The tab 32' is similar to the tab 32 and is manipulatable similarly. Moreover, except as illustrated in FIGS. 3 and 4, the tab 42' is similar to the tab 42 and is manipulatable similarly.

As illustrated in FIG. 4, when the tab 32' extending from the intermediate liner is manipulated to its indicating position, the tab 32' displays a partial indicium "19" to be later described. Moreover, when the tab 32' extending from the intermediate liner is manipulated to its indicating position, the tab 32' may display other indicia ("1951", "1992", "1999") similar to other indicia displayed by the tab 32 when manipulated similarly. The tab 32' is embroidered with the partial indicium and, if included, with the other indicia.

As illustrated in FIG. 4, the tab 42' is shorter, when compared to the tab 32', and is disposed so as to overlie the tab 32' when each tab 32', 42', is manipulated to its indicating position. Moreover, when the tab 42' extending from the intermediate liner is manipulated to its indicating position, the tab 42' displays a partial indicium "71", with which the tab 42 is embroidered and which disposed so as to be readable with the partial indicium "19" if the tab 32' is manipulated to its indicating position, as an indicium "1971", which is an abbreviated indication that the protective coat 20 with the outer shell 20, with the intermediate liner 30, and with the inner liner 40, conforms to NFPA 1971.

As means for enabling the tab 32' extending from the intermediate liner to be detachably attached to the outer shell 20', the protective coat 10' comprises hook-and-loop fastening means (e.g. Velcro™ fastening means) comprising a hook-faced panel 36' sewn to an end portion 38' of the tab 32' and coactive with a loop-faced panel 50' sewn to the outer shell 20'. As means for enabling the tab 42' extending from the inner liner to be detachably attached to the tab 32', when each tab 32', 42', is manipulated to its indicating position, the protective coat 10' comprises similar fastening means comprising a loop-faced panel 46' sewn to an end portion 38' of the tab 42' and coactive with a hook-faced panel 60' sewn to the tab 32', whereby the tab 42' is attachable directly to the tan 32' and, thus, indirectly to the outer shell 20'. Because the loop-faced panel 46' sewn to the end portion 48' of the tab 40' is not coactive with the loop-faced panel 50' sewn to the outer shell 20', these fastening means do not enable the tab 42' to be directly attached to the outer shell 20'.

In each of the first and second embodiments, rather than hook-and-loop fastening means, other fastening means, such as snap fasteners having coactive male and female elements or such as buttons coactive with buttonholes, may be employed.

Although this invention, as illustrated and as described above, is embodied in a protective coat, this invention can be similarly embodied in protective garments of different types, such as protective pants, protective overalls, or protective coveralls.

The invention claimed is:

1. A protective garment comprising an outer shell, an intermediate liner wearable within the outer shell, and an inner liner wearable within the intermediate liner, and further comprising means for indicating visually to a person observing the outer shell, while the protective garment is being worn, whether the intermediate liner is being worn and whether the inner liner is being worn;

wherein the indicating means comprises a tab extending from the intermediate liner and being visible to a person observing the outer shell, while the protective garment is being worn, if the intermediate liner is being worn, and wherein the indicating means comprises a tab extending from the inner liner and being visible to a person observing the outer shell, while the protective garment is being worn, if the inner liner is being worn; and wherein the tab extending from the intermediate liner is manipulatable to an indicating position, in which the tab extending from the intermediate liner can be detachably attached to the outer shell and in which the tab extending from the intermediate liner indicates to a person observing the outer shell, while the protective garment is being worn, that the intermediate liner is being worn and wherein the tab extending from the inner liner is manipulatable to an indicating position, in which the tab extending from the inner liner can be detachably attached to the tab extending from the intermediate liner and in which the tab extending from the inner liner indicates to a person observing the outer shell, while the protective garment is being worn, that the inner liner is being worn.

2. A protective garment comprising an outer shell, an intermediate liner wearable within the outer shell, and an inner liner wearable within the intermediate liner, and further comprising means for indicating visually to a person observing the outer shell, while the protective garment is being worn, whether the intermediate liner is being worn and whether the inner liner is being worn; and wherein the tab extending from the intermediate liner, when manipulated to the indicating position, displays an indicium or indicia that the protective garment conforms to at least one standard for protective garments and wherein the tab extending from the inner liner, when manipulated to the indicating position, displays an indicium or indicia that the protective garment conforms to at least one for protective garments, the indicated standards being different standards.

3. The protective garment of claim 2, wherein the indicating means comprises a tab extending from the intermediate liner and being visible to a person observing the outer shell, while the protective garment is being worn, if the intermediate liner is being worn, and wherein the indicating means comprises a tab extending from the inner liner and being visible to a person observing the outer shell, while the protective garment is being worn, if the inner liner is being worn.

4. The protective garment of claim 3, wherein the tab extending from each liner is manipulatable to an indicating position, in which the tab extending from said liner can be detachably attached to another part of the protective garment and in which the tab extending from said liner indicates to a person observing the outer shell, while the protective garment is being worn, that said liner is being worn.

5. The protective garment of claim 3, wherein the tab extending from each liner is manipulatable to an indicating position, in which the tab extending from said liner can be detachably attached to the outer shell and in which the tab extending from said liner indicates to a person observing the outer shell, while the protective garment is being worn, that said liner is being worn.

6. The protective garment of claim 3, wherein the tab extending from the intermediate liner is manipulatable to an indicating position, in which the tab extending from the intermediate liner can be detachably attached to the outer shell and in which the tab extending from the intermediate liner indicates to a person observing the outer shell, while the protective garment is being worn, that the intermediate liner is being worn, wherein the tab extending from the inner liner is manipulatable to an indicating position, in which the tab extending from the inner liner can be detachably attached to the outer shell and in which the tab extending from the inner liner indicates to a person observing the outer shell, while the protective garment is being worn, that the inner liner is being worn, and wherein the tabs are spaced from each other when and where so attached to the outer shell.

7. The protective garment of claim 1, wherein the protective garment further comprises means for enabling the tab extending from the intermediate liner to be detachably attached to the outer shell and means for enabling the tab extending from the inner liner to be detachably attached to the tab extending from the intermediate liner, so as to be indirectly attachable to the outer shell, but not enabling the tab extending from the inner liner to be directly attachable to the outer shell.

8. The protective garment of claim 2, wherein the tab extending from the inner liner, when manipulated to the indicating position, masks at least part of another indicium displayed by the protective garment.

9. The protective garment of claim 2, wherein the outer shell displays an indicium that the protective garment conforms to at least one standard for protective garments.

10. The protective garment of claim 9, wherein the tab extending from the each liner, when manipulated to the indicating position, masks at least part of another indicium displayed by the protective garment.

* * * * *